US006548466B1

(12) United States Patent
Murphy et al.

(10) Patent No.: US 6,548,466 B1
(45) Date of Patent: Apr. 15, 2003

(54) HETEROCYCLIC DRY-CLEANING SURFACTANT AND METHOD FOR USING THE SAME

(75) Inventors: Dennis Stephen Murphy, Wyckoff, NJ (US); Robert Joseph Ahart, Mahwah, NJ (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/255,250

(22) Filed: Sep. 26, 2002

Related U.S. Application Data

(62) Division of application No. 09/930,094, filed on Aug. 15, 2001, now Pat. No. 6,482,784, which is a continuation of application No. 09/517,166, filed on Mar. 2, 2000, now Pat. No. 6,313,079.

(51) Int. Cl.[7] ..... C11D 3/28; C11D 3/43

(52) U.S. Cl. ..... 510/285; 510/405; 510/407; 510/466; 510/500; 8/142

(58) Field of Search ..... 8/142; 510/285, 510/405, 407, 500, 466

(56) References Cited

U.S. PATENT DOCUMENTS 5,294,644 A * 3/1994 Login et al. ..... 514/698
5,683,977 A 11/1997 Jureller et al.
5,746,776 A * 5/1998 Smith et al. ..... 8/142
5,888,250 A 3/1999 Hayday et al.
5,942,007 A 8/1999 Berndt et al.
6,313,079 B1 * 11/2001 Murphy ..... 510/285

FOREIGN PATENT DOCUMENTS

| | | |
|---|---|---|
| EP | 1092803 A1 | 4/2001 |
| WO | 97/16264 | 5/1997 |
| WO | 99/10585 | 3/1999 |
| WO | 99/10587 | 3/1999 |

OTHER PUBLICATIONS

European Search Report Application No. EP 01 20 0406 dated Jun. 21, 2001.

Derwent Publication XP 002170288 & JP 04 057963 A (Kobayashi Seiyaku K).

* cited by examiner

*Primary Examiner*—Charles Boyer
(74) *Attorney, Agent, or Firm*—Ronald A. Koatz

(57) ABSTRACT

This invention is directed to a surfactant comprising a heterocyclic group that results in superior cleaning in a dry cleaning system. The surfactant can have one or more heteroatom and can result in reverse micelle formation in a densified gas like densified carbon dioxide.

12 Claims, No Drawings

HETEROCYCLIC DRY-CLEANING SURFACTANT AND METHOD FOR USING THE SAME

This is a Divisional of U.S. Ser. No. 09/930,094, filed Aug. 15, 2001, now, U.S. Pat No. 6,482,784 which is a Continuation of U.S. Ser. No. 09/517,166, filed Mar. 2, 2000, now U.S. Pat. No. 6,313,079 B, issued Nov. 6, 2001.

FIELD OF THE INVENTION

This invention is directed to a surfactant comprising a heterocyclic group. More particularly, the invention is directed to a surfactant comprising a heterocyclic group that results in superior cleaning properties in a dry cleaning system.

BACKGROUND OF THE INVENTION

In many cleaning applications, it is desirable to remove contaminants (e.g., stains) from substrates, like metal, ceramic, polymeric, composite, glass and textile comprising substrates. Particularly, it is highly desirable to remove contaminants from clothing whereby such contaminants include dirt, salts, food stains, oils, greases and the like.

Typically, dry-cleaning systems use organic solvents, like chlorofluorocarbons, perchloroethylene and branched hydrocarbons to remove contaminants from substrates. In response to environmental concerns, other dry-cleaning systems have been developed that use inorganic solvents, such as densified carbon dioxide, to remove contaminants from substrates. The systems that use carbon dioxide to remove contaminants from substrates generally employ a surfactant and a polar co-solvent so that a reverse micelle may be formed to trap the contaminant targeted for removal.

In view of the environmental concerns associated with dry cleaning in, for example, halogenated hydrocarbons, many cleaning establishments have expressed their interests in cleaning with continuous phase solvents that comprise densified gases such as densified carbon dioxide as well as a biodegradable functionalized hydrocarbon or a silicon comprising surfactant. Unfortunately, however, cleaning with such solvents is not made easy because only very few surfactants are compatible with such continuous phases.

It is of increasing interest to develop surfactants that enhance cleaning in a system that uses a densified gas, functionalized biodegradable hydrocarbon and/or a silicon comprising solvent. This invention, therefore, is directed to a surfactant comprising a heterocyclic group that unexpectedly results in superior cleaning properties in a dry cleaning system that utilizes a densified gas, a functionalized biodegradable hydrocarbon and/or silicon comprising solvent.

BACKGROUND MATERIAL

Efforts have been disclosed for dry cleaning with carbon dioxide. In U.S. Pat. No. 5,676,705, a superior dry cleaning method which employs densified carbon dioxide is described.

Other efforts have been disclosed for dry cleaning with carbon dioxide. In U.S. Pat. No. 5,683,473, a superior method for dry cleaning fabrics with a surfactant having a polysiloxane, branched polyalkylene oxide or halocarbon group is described.

Still further, U.S. Pat. No. 5,683,977 discloses a superior dry cleaning system with carbon dioxide and a surfactant adjunct.

Finally, in U.S. Pat. No. 5,866,005, a cleaning process using carbon dioxide as a solvent along with molecularly engineered surfactants is described.

SUMMARY OF THE INVENTION

In a first embodiment, the present invention is directed to a dry cleaning system comprising a surfactant having the formula:

A–Z wherein A is a portion of the surfactant that is soluble in carbon dioxide and Z is a portion of the surfactant that is not soluble in carbon dioxide and Z comprises a heterocyclic group, with the provisos that:

(i) when Z is pyrrolidone, nitrogen is not substituted with a hydrocarbon having less than five carbon atoms;

(ii) when Z is a polymeric vinyl pyrrolidone, the dry cleaning system is a system for removing soil from fabrics;

(iii) when A is a polysiloxane, Z is not a beta carboxylic acid substituted pyrrolidone having the polysiloxane joined to nitrogen with a bridging radical; and (iv) when A is not a hydrocarbon, Z is not a carbohydrate.

In a second embodiment, the present invention is directed to a method for dry cleaning using the dry cleaning system of the first embodiment.

DETAILED DESCRIPTION OF THE PREFERRED EMBODIMENTS

There generally is no limitation with respect to the surfactant used in this invention as long as the surfactant will enhance cleaning in a system which utilizes a continuous phase solvent comprising a densified gas, biodegradable functionalized hydrocarbon or a silicon comprising solvent, and the surfactant meets the criteria set forth in the above-described provisos (i)–(iv).

Often, the surfactants which may be used in this invention are selected from the group consisting of

I

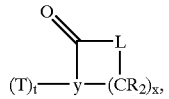

II

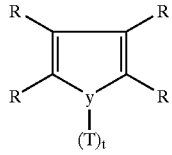

and

III

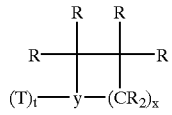

wherein each R and T are independently a hydrogen, $C_5$ to $C_{18}$ hydrocarbon, polysiloxane, $CO_2$ soluble polyalkylene oxide or halocarbon, with the proviso that at least T or one R group is not hydrogen, L is $C(R_2)$ or y-$(T)_t$, x is an integer from about 1 to about 6, each y is independently N, P, S, B or O and t is 0 or 1 with the proviso that t is 0 when y is oxygen.

In a preferred embodiment the hydrocarbon is a $C_6$ to $C_{12}$ hydrocarbon, the polysiloxane is polydimethysiloxane with or without polypropylene oxide substituents and having a weight average molecular weight of about 200 to about 200,000, the polyalkylene oxide is polypropylene oxide having a weight average molecular weight of about 100 to about 100,000, and the halocarbon is a $C_2$ to $C_8$ fluoroalkylene or fluoroalkenylene, x is an integer from about 2 to about 4 and the heteroatom is N. The preferred polysiloxanes and halocarbons are derived from those described in U.S. Pat. Nos. 5,676,705, 5,683,473 and 5,683,977, the disclosures of which are incorporated herein by reference. The preferred polysiloxanes are often bridged to the heterocyclic group with a $C_1$ to $C_{20}$ hydrocarbon bridging radical, and preferably, a $C_3$ hydrocarbon bridging radical.

In a most preferred embodiment, structure I represents the surfactant comprising a heterocyclic group and each R is hydrogen, y is N, T is a $C_8$ or $C_{12}$ hydrocarbon, L is $C(R_2)$, x is 2 and t is 1. When T is a $C_8$ hydrocarbon, such a surfactant is sold under the name Surfadone LP-100 and when T is a $C_{12}$ hydrocarbon, such a surfactant is sold under the name Surfadone LP-300, both of which are made commercially available by International Specialty Products. Still another most preferred embodiment results when at least one R is a $C_5$ to $C_{18}$ group, L is oxygen, y is oxygen and x is 2.

The surfactant comprising the heterocyclic group which may be used in this invention can be prepared via numerous well known processes which include the condensation of butyrolactone with methylamine. Such reactions are disclosed in The Kirk-Othmer Encyclopedia of Chemical Technology, Volume 20, 4th Edition, pages 697–720 (1996), the disclosure of which is incorporated herein by reference.

Other surfactants comprising heterocyclic groups which may be used in this invention (as defined by the formulas above) include those made and described in Introduction to Organic chemistry, Second Edition, Streitwieser, Jr. et al., Chapter 32 (1981), the disclosure of which is incorporated herein by reference.

Still other surfactants that may be used in this invention (as defined by the formulas above) include those prepared by a conventional hydrosilation reaction wherein at least one reactant comprises a heterocyclic group.

If desired, the surfactants which can be employed in this invention may be purchased from suppliers such as BASF, Arco and, again, International Specialty Products.

There generally is no limitation with respect to the continuous phase solvent (i.e., fluid) which may be employed with the surfactants comprising a heterocyclic group of this invention other than that the solvent is a densified gas (e.g., fluid which is a gas at standard temperature and pressure), a biodegradable hydrocarbon or a silicon comprising solvent, and capable of being a continuous phase in a dry cleaning application. Illustrative examples of the types of solvents which may be employed in this invention include a $C_2$–$C_4$ substituted or unsubstituted alkane, carbon dioxide, silicone oil, and an azeotropic solvent.

Regarding the solvent which is a densified gas, such a solvent may be, within the dry cleaning composition or process, a gas, liquid or supercritical fluid depending upon how densified the solvent is (how much pressure is applied at a given temperature) in the domestic or commercial cleaning application the solvent is used in. Propane and carbon dioxide tend to be the preferred solvents when the solvent selected is one which is a densified gas. Carbon dioxide, however, is especially preferred.

As to the silicon comprising solvent which may be used in this invention, such a solvent is typically a commercially available cyclic-siloxane based solvent made available from GreenEarth Cleaning, LLC. Such a solvent is generally one which has a flash point over about 65° C., with octamethyl-cyclotetrasiloxane and decamethyl-cyclopentasiloxane being most preferred. A more detailed description of such conventional siloxane comprising solvents may be found in U.S. Pat. No. 5,942,007, the disclosure of which is incorporated herein by reference.

Especially preferred silicon comprising solvents are those having the formula:

IV

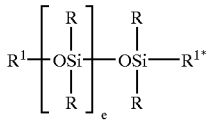

wherein each R is independently a substituted or unsubstituted linear, branched or cyclic $C_{1-10}$ alkyl, $C_{1-10}$ alkoxy, substituted or unsubstituted aryl, aryloxy, trihaloalkyl, cyanoalkyl or vinyl group, and $R^1$ is a hydrogen or a siloxyl group having the formula:

$$Si\,(R^2)_3 \qquad \text{V}$$

and each $R^2$ is independently a linear, branched or cyclic $C_{1-10}$ substituted or unsubstituted alkyl, $C_{1-10}$ alkoxy, substituted or unsubstituted aryl, trihaloalkyl, cyanoalkyl, vinyl group, amino, amido, ureido or oximo group, and $R^{1*}$ is an unsubstituted or substituted linear, branched or cyclic $C_{1-10}$ alkyl or hydroxy, or $OSi(R^2)_3$ whereby $R^2$ is as previously defined, and e is an integer from about 0 to about 20.

The most preferred linear siloxane solvent is one wherein each R is methyl, $R^1$ is $Si\,(R^2)_3$, $R^2$ is methyl and $R^{1*}$ is methyl. Preferably, e is an integer from about 0 to about 10, and most preferably, an integer from about 2 to about 5.

Such solvents are made commercially available by General Electric, and Dow Corning under the name Dow Corning 200(R) fluid. A description of the solvents may be found in U.S. Pat. Nos. 3,931,047 and 5,410,007, the disclosures of which are incorporated herein by reference.

The biodegradable functionalized hydrocarbon that may be used in this invention includes those generally classified as an azeotropic solvent. Such an azeotropic solvent often comprises alkylene glycol alkyl ethers, like propylene glycol tertiary-butyl ether, and is described in U.S. Pat. No. 5,888,250, the disclosure of which is incorporated herein by reference. Moreover, as used herein, biodegradable functionalized hydrocarbon is defined to mean a biodegradable hydrocarbon comprising at least one member selected from the group consisting of an aldehyde, ketone, alcohol, alkoxy, ester, ether, amine, amide and sulfur comprising group.

When dry cleaning, for example, fabrics, like clothing or garments, with a solvent that is a densified gas (and the surfactants of this invention), the machine which is employed for cleaning is well known in the art. Such a machine typically comprises a gas supply, cleaning tank and condenser. The machine may further comprise a means for agitation. The means for agitation may be, for example, a mechanical device like a mechanical tumbler, or a gas-jet agitator. The art recognized machines which may be used in this invention (e.g., when a densified gas is used) may be found in U.S. Pat. Nos. 6,012,307, 5,943,721, 5,925,192, 5,904,737, 5,412,958, 5,267,455 and 4,012,194, the disclosures of which are incorporated herein by reference.

When dry cleaning for example, fabrics, like clothing or garments, with the biodegradable functionalized hydrocarbons or silicon comprising solvents and the surfactants described in this invention, the type of machine that may be used for the dry cleaning process is the same or substantially the same as the commonly used dry cleaning machines used for dry cleaning with perchloroethylene. Such machines typically comprise a solvent tank or feed, a cleaning tank, distillation tanks, a filter and solvent exit. These commonly used machines are described, for example, in U.S. Pat. No. 4,712,392, the disclosure of which is incorporated herein by reference.

When the fabric is placed in the machine and the continuous phase solvent of choice is fed into the machine, the normal cleaning cycle is run (typically between ten (10) minutes and one (1) hour). Prior to or after the start of the cleaning cycle, the heterocyclic surfactant of this invention is introduced into the cleaning machine. Any of the surfactants represented by formulae I to III may be used, including any combination thereof. Often, the amount of surfactant employed is from about 0.001 to about 15.0%, and preferably, from about 0.01 to about 5.0%, and most preferably, from about 0.01 to about 3.0% by weight of surfactant, based on total weight of surfactant and continuous phase solvent, including all ranges subsumed therein.

In addition to continuous phase solvent and the surfactant described in this invention, it is especially preferred to add from about 0.01% to about 10.0%, and preferably, from about 0.03 to about 3.0%, and most preferably, from about 0.05 to about 0.3% by weight of a polar additive (e.g., $C_{1-10}$ alcohol and preferably water) based on total weight of continuous phase solvent, surfactant and polar additive, including all ranges subsumed therein. The addition of polar additive to the continuous phase solvent and surfactant is often desired so that cleaning may be enhanced, for example, by the formation of reverse micelles.

When cleaning fabrics, for example, with the surfactants of this invention, the pressure and temperature of the dry cleaning system (e.g., the system comprising the fabric targeted for cleaning, the continuous phase solvent and the surfactant described in this invention) within the machine is limited only to the extent that the temperature and pressure allow for the fabric to be cleaned. The pressure is often from about 14.7 to about 10,000 psi, and preferably, from about 200 to about 5,000 psi, and most preferably, from about 250 to about 3,000 psi, including all ranges subsumed therein. The temperature is often from about −30.0 to about 100° C., and preferably, from about −5.0 to about 70.0° C., and most preferably, from about 0.0 to about 45° C., including all ranges subsumed therein.

It is also noted herein that optional additives may be employed when cleaning with the surfactants described in this invention. Such optional additives include an oxidizing agent, like hydrogen peroxide, and an organic bleach activator such as those represented by the formula:

VI

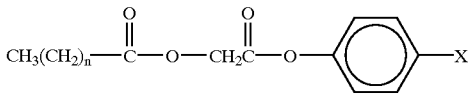

wherein n is an integer from about 0 to about 20 and X is hydrogen or $SO_3M$ and M is hydrogen, an alkaline metal or an immodium cation. A more detailed description of such additives may be found in U.S. Pat. No. 5,431,843, the disclosure of which is incorporated herein by reference.

Other optional additives that may be employed to clean with the surfactants described in this invention include anti-static agents and deodorizing agents. Such anti-static agents typically include $C_8$–$C_{12}$ alcohol ethoxylates, $C_8$–$C_{12}$ alkaline glycols and glycol esters. The deodorizing agent, on the other hand, typically includes fragrances such as those described in U.S. Pat. No. 5,784,905, the disclosure of which is incorporated herein by reference.

Still other optional additives include viscosity modifiers like propylene glycol and sodium xylene sulphonate. As to the amount of optional additives used with the surfactants of the present invention, such an amount is limited only to the extent that the additive does not interfere with the cleaning process.

The examples below are provided for illustrative purposes, and they are not intended to restrict the scope of the invention. Thus, various changes may be made to the specific embodiments of this invention without departing from its spirit. Accordingly, the invention is not to be limited to the precise embodiment shown and described, but only as indicated in the following claims.

Percent Stain Removal =

$$\frac{\text{Stain removed}}{\text{Stain applied}} = \frac{\text{stained cloth reading after cleaning} - \text{stained cloth reading}}{\text{unstained cloth reading} - \text{stained cloth reading}} \times 100$$

EXAMPLE

Polyester cloths (about 5.0 cm×7.5 cm) [commercially available from Textile Innovators Corp.] were soaked (for about 30 minutes) in concentrated grape juice (consumer grade Welch's) that was diluted 1:4 with water. The cloths were then removed and dried overnight on plastic sheets. The resulting stained cloths were then placed in a conventional 300 ml autoclave [available from Autoclave Engineers] (one at a time for each test) having a gas compressor and an extraction system. The stained cloth was hung from the bottom of the autoclave's overhead stirrer using a copper wire to promote good agitation during washing and extraction. Subsequent to placing the cloth in the autoclave and sealing it, liquid $CO_2$ at a tank pressure of 850 psi was allowed into the system and was cooled to reach a temperature of about 11° C. at which point the $CO_2$ pressure was reduced to about 800 psi. The stirrer was then turned on for 15 minutes to mimic a machine washing cycle. At the completion of the wash cycle, 20 cubic feet of fresh $CO_2$ were passed through the system to mimic a machine rinse cycle. The pressure of the autoclave was then released to atmospheric pressure and the cleaned cloths were removed from the autoclave. To measure the extent of cleaning, spectrophotometric readings were taken using a Hunter Ultrascan XE Spectrophotometer. The R scale, which measures darkness from black to white, was used to determine stain removal. Cleaning results were reported as percent stain removal using the formula above.

Two different heterocyclic dry cleaning surfactants were used alone or in combination with 0.2 ml of water and liquid carbon dioxide (densified gas). The control was liquid carbon dioxide alone. The water was added directly to the bottom of the autoclave and not on the stain itself and the surfactant was applied directly to the stain on the cloth. After the wash and rinse cycles, cleaning results were evaluated and reported in Table below.

TABLE

Dry Cleaning Results on Grape Juice Stains Using Densified Carbon Dioxide and Heterocyclic Dry Cleaning Surfactants

| Stain | Cloth | Surfactant | Polar Additive | % Stain Removal |
|---|---|---|---|---|
| Grape juice | Polyester | None | None | 2.5 |
| Grape juice | Polyester | None | 0.5 ml water | 0.3 |
| Grape juice | Polyester | 0.2 g Surfadone LP-100[1] | 0.2 ml water | 33.0 |
| Grape juice | Polyester | 0.2 g Surfadone LP-300[1] | 0.2 ml water | 36.7 |

[1]Commercially available from International Specialty Products

It is clear from the data above that the combination of water with a heterocyclic dry cleaning surfactant of this invention results in improved dry cleaning in liquid carbon dioxide. Liquid carbon dioxide alone or with water added did not appreciably clean the stain.

What is claimed is:

1. A dry cleaning system comprising:

(a) a continuous phase solvent selected from a silicone comprising solvent; and (b) a surfactant comprising the formula:

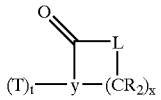

wherein each R and T are independently a hydrogen, $C_5$ to $C_{18}$ hydrocarbon, polysiloxane, $CO_2$ soluble polyalkylene oxide or halocarbon, with the proviso that at least T or one R group is not hydrogen, L is $C(R_2)$ or y-$(T)_t$, x is an integer from about 1 to about 6, each y is independently N, P, S, B or O and t is 0 or 1 with the proviso that t is 0 when y is oxygen.

2. The dry cleaning system according to claim 1 wherein the dry cleaning system further comprises a polar additive.

3. The dry cleaning system according to claim 2 wherein the polar additive is water.

4. The dry cleaning system according to claim 1 wherein the hydrocarbon is a $C_6$ to $C_{12}$ hydrocarbon, the polysiloxane is polydimethylsiloxane with or without propylene oxide substituents and having a weight average molecular weight of about 200 to about 200,000, the polyalkylene oxide is polypropylene oxide having a weight average molecular weight of about 100 to about 100,000, and the halocarbon is a $C_2$ to $C_8$ fluoroalkylene or fluoroalkenylene, x is an integer from about 2 to about 4 and the heteroatom is N.

5. The dry cleaning system according to claim 1 wherein R is a $C_5$ to $C_{18}$ group, y is oxygen and x is 2.

6. The dry cleaning system according to claim 1 wherein the silicone comprising solvent is a cyclic or linear siloxane.

7. A method for dry cleaning fabric comprising the steps of contacting the fabric with the dry cleaning system of claim 1.

8. The method for dry cleaning fabric according to claim 7 wherein the method further comprises a step of contacting the fabric with a polar additive.

9. The method for dry cleaning a fabric according to claim 8 wherein the polar additive is water.

10. The method for dry cleaning a fabric according to claim 7 wherein the hydrocarbon is a $C_6$ to $C_{12}$ hydrocarbon, the polysiloxane is a polydimethyl siloxane with or without propylene oxide substituents and having a weight average molecular weight of about 200 to about 200,000, the polyalkylene oxide is polypropylene oxide having a weight average molecular weight of about 100 to about 100,000, and the halocarbon is a $C_2$ to $C_8$ fluoroalkylene or fluoroalkenylene, X is an integer from about 2 to about 4 and the heteroatom is N.

11. The method for dry cleaning a fabric according to claim 7 wherein R is a C5 to C18 group, L is oxygen, y is oxygen and x is 2.

12. The method for dry cleaning a fabric according to claim 7 wherein the silicone comprising solvent is a cyclic or linear siloxane.

* * * * *